US009708825B1

(12) United States Patent
Delgado et al.

(10) Patent No.: US 9,708,825 B1
(45) Date of Patent: Jul. 18, 2017

(54) SYSTEM TO HEAT AND COOL A HOUSE AND/OR POOL USING ONE COMPRESSOR

(71) Applicants: Jorge Delgado, Hialeah, FL (US); Raul Monzon De Leon, West Palm Beach, FL (US)

(72) Inventors: Jorge Delgado, Hialeah, FL (US); Raul Monzon De Leon, West Palm Beach, FL (US)

( * ) Notice: Subject to any disclaimer, the term of this patent is extended or adjusted under 35 U.S.C. 154(b) by 0 days.

(21) Appl. No.: 14/886,011

(22) Filed: Oct. 17, 2015

(51) Int. Cl.
*F25B 6/00* (2006.01)
*E04H 4/12* (2006.01)

(52) U.S. Cl.
CPC ..... *E04H 4/129* (2013.01)

(58) Field of Classification Search
CPC ..... E04H 4/1209; E04H 4/129; E04H 4/00; E04H 4/12; F24B 6/02; F24B 6/04; F24B 30/032; F24B 2339/047; F24F 5/0071; F24D 17/0005; F24D 17/001; F24D 2200/12; F25B 6/02; F25B 6/00
USPC ..... 62/238.6
See application file for complete search history.

(56) References Cited

U.S. PATENT DOCUMENTS 4,019,338 A * 4/1977 Poteet ..... E04H 4/129 62/238.1
5,184,472 A * 2/1993 Guilbault ..... F24J 2/423 62/160
5,560,216 A 10/1996 Holmes
5,906,104 A * 5/1999 Schwartz ..... F24F 5/0071 237/2 B
6,122,922 A * 9/2000 Conner ..... F24F 5/0071 62/183
2008/0245087 A1* 10/2008 Orcutt ..... F25B 6/04 62/238.7

* cited by examiner

*Primary Examiner* — Mohammad M Ali
(74) *Attorney, Agent, or Firm* — Christian Sanchelima; Jesus Sanchelima

(57) ABSTRACT

A heating and cooling system that can efficiently and effectively heat a pool and cool a home simultaneously or independently with one compressor and one condenser. The present invention uses a combination of four-way valves to selectively activate the system's components depending on instructions sent by the home or pool thermostats.

7 Claims, 6 Drawing Sheets

SYSTEM TO HEAT AND COOL A HOUSE AND/OR POOL USING ONE COMPRESSOR

BACKGROUND OF THE INVENTION

1. Field of the Invention

The present invention relates to a pool and home heating and cooling system and, more particularly, to such a system that can heat a pool and cool a house using only one compressor and having a hybrid unit that works as both a condenser and evaporator.

2. Description of the Related Art

Several designs for heating and cooling systems have been designed in the past. None of them, however, include a system that is able to heat a pool and optionally or simultaneously cool a home using one compressor and a condenser/evaporator hybrid unit.

Applicant believes that a related reference corresponds to U.S. Pat. No. 5,560,216 issued to Robert Holmes. The Holmes reference teaches of a combination air conditioner and pool heater having a condensing unit and a compressor. However, it differs from the present invention because the Holmes reference does not teach of a condenser/evaporator hybrid unit that can heat the pool even if the house is cool.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a heating and cooling system that can heat a pool and cool a house at the same time or separately.

It is another object of this invention to provide a heating and cooling system using the minimum amount of components to reduce installation and parts costs.

It is still another object of the present invention to provide a system that only requires one compressor and uses an evaporator/condenser hybrid unit to both heat a pool and cool a house.

It is yet another object of this invention to provide such a system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
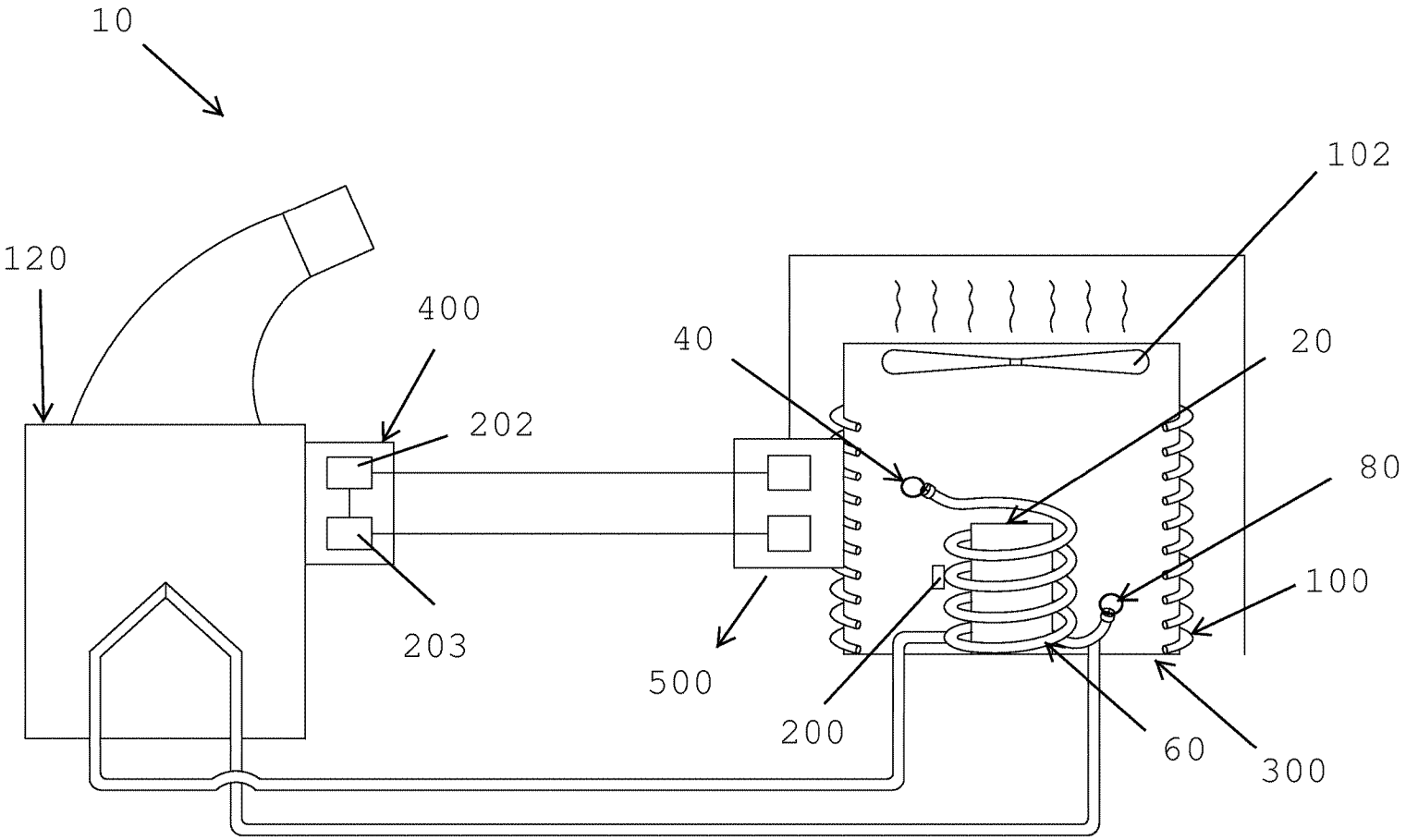
FIG. 1 is a schematic showing hybrid unit 300 connected to home evaporator 120. The components shown in FIGS. 1-4, with the exception of home expansion valve 90 and home evaporator 120, can all be seen housed within hybrid unit 300.

Referring now to the drawings, where the present invention is generally referred to with numeral 10, it can be observed that it basically includes compressor 20, first 4-way valve 40, water condenser 60, second 4-way valve 80, and hybrid unit evaporator/condenser 100 housed within hybrid evaporator/condenser unit 300.

Figure 2:
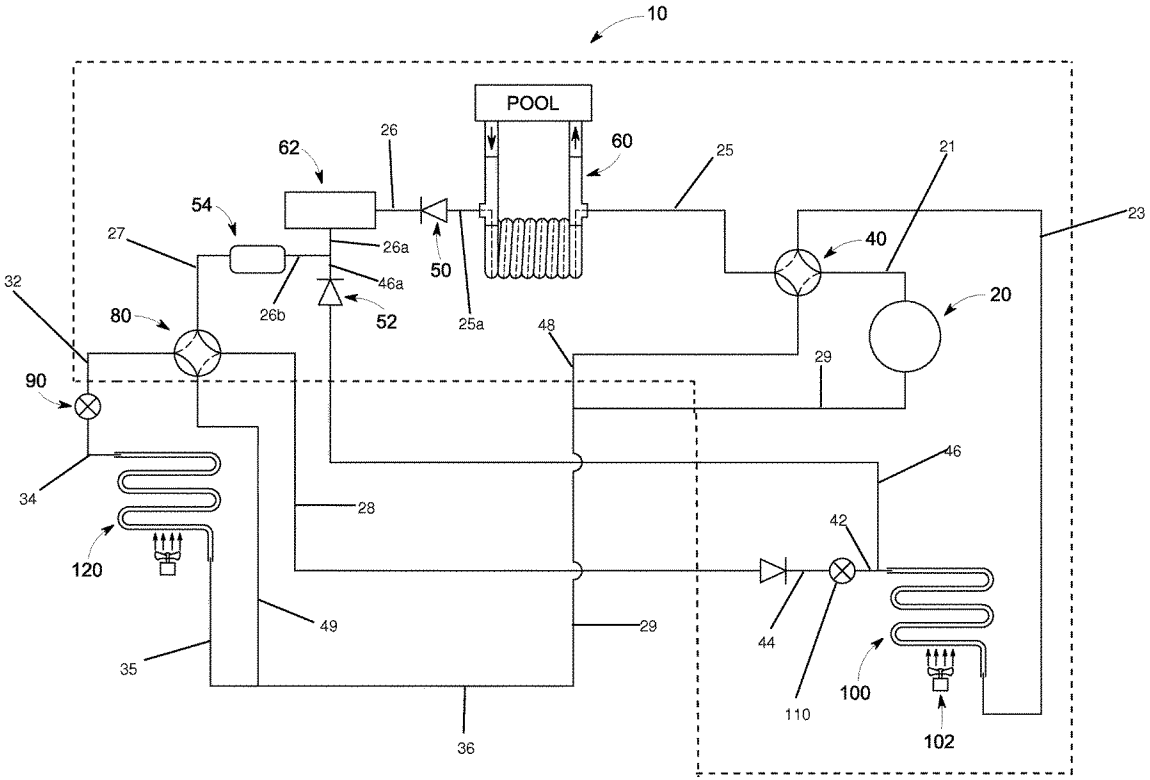
FIG. 2 represents a general schematic of the stages of the present invention including all of its components. All of the components, with the exception of home evaporator expansion valve 90 and home evaporator 120 are included within the same hybrid unit 300 seen in FIG. 1. They are separated in this view for the purposes of explaining how each stage of the system operates.
Figure 6:
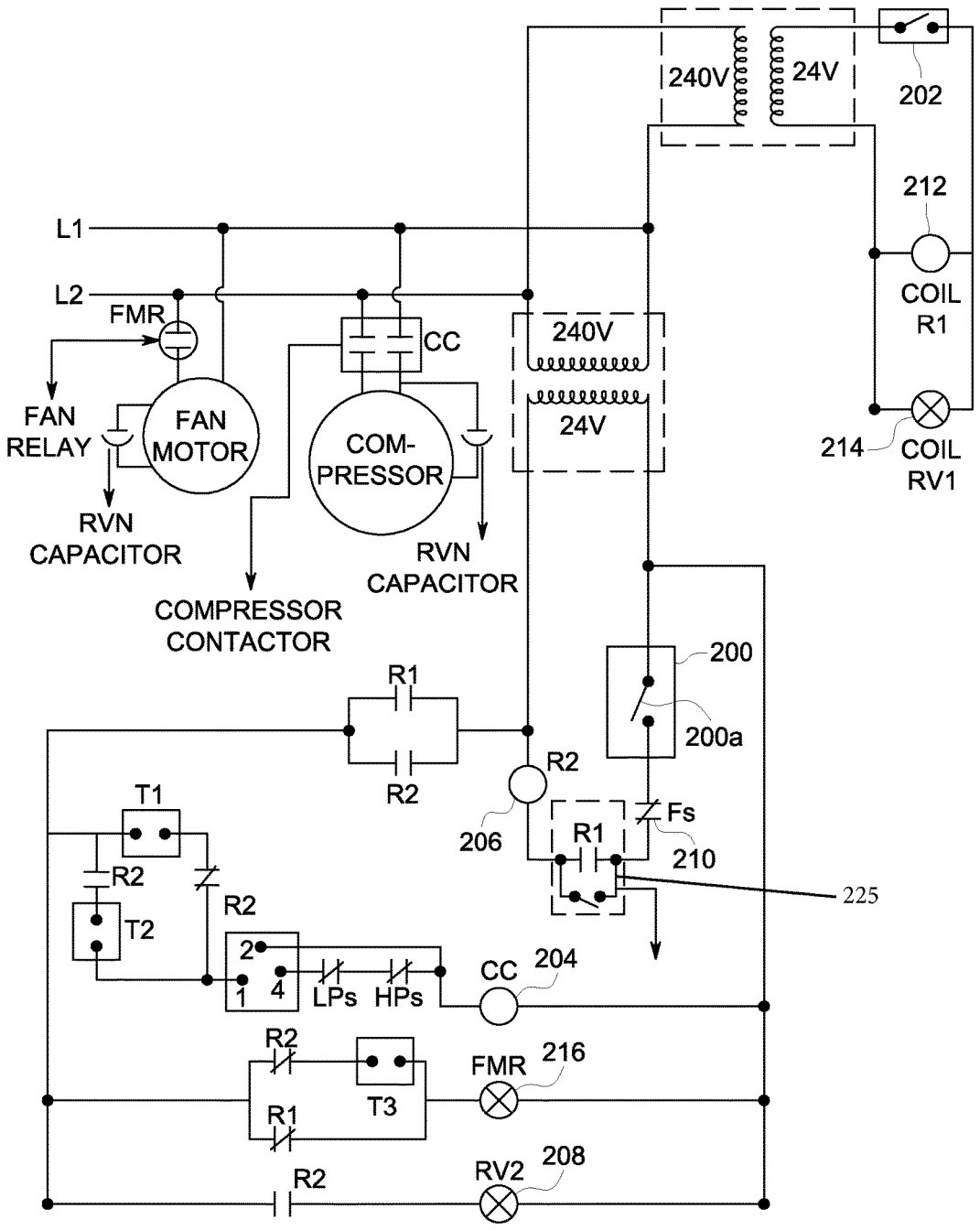
FIG. 6 shows a schematic of the electrical components of the present invention.

Compressor 20 is connected to first 4-way valve 40 as shown in FIG. 2 using tube 21. Compressor 20 distributes hot gas to first 4-way valve 40 when either pool thermostat 200 or home thermostat 202 transmits a signal to compressor contact 204 as shown in FIG. 6. Pool thermostat 200 receives 24V alternating current. In the event that pool thermostat 200 signals that the pool requires heating, pool thermostat switch 200*a* closes and the current is received by pool relay 206. When pool relay 206 is actuated current is allowed to pass to first valve coil 208 of first 4-way valve 40. This actuation permits the hot gas distributed by compressor 20 to pass through to water condenser 60 using tube 25, which is housed within hybrid evaporator/condenser unit 300.

As shown in FIG. 1, the hot gas passes through the coils of water condenser 60 having pool water circulating around the water condenser coils, thereby heating the pool water. As seen in FIG. 6, flow switch 210 can be added to the pipes of water condenser 60 to determine if there is water flow in the system. If the motor for pumping pool water into condenser 60 becomes damaged then water flow therein will become interrupted. Flow switch 210 at not sensing water will send a signal to the first four way valve 40 so that the hot gas is passed to hybrid condenser/evaporator 100 that acts as a condenser and home evaporator 120 will act as its evaporator before suctioning resulting vapor to compressor 20. As seen in FIG. 2, water condenser 60 is connected using tube 25*a* to first check valve 50 that prevent gas or liquids from entering water condenser 60 the wrong way. Water condenser 60 is further connected to liquid receiver 62 using tube 26 that stores liquid flowing out of water condenser 60.

Figure 3:
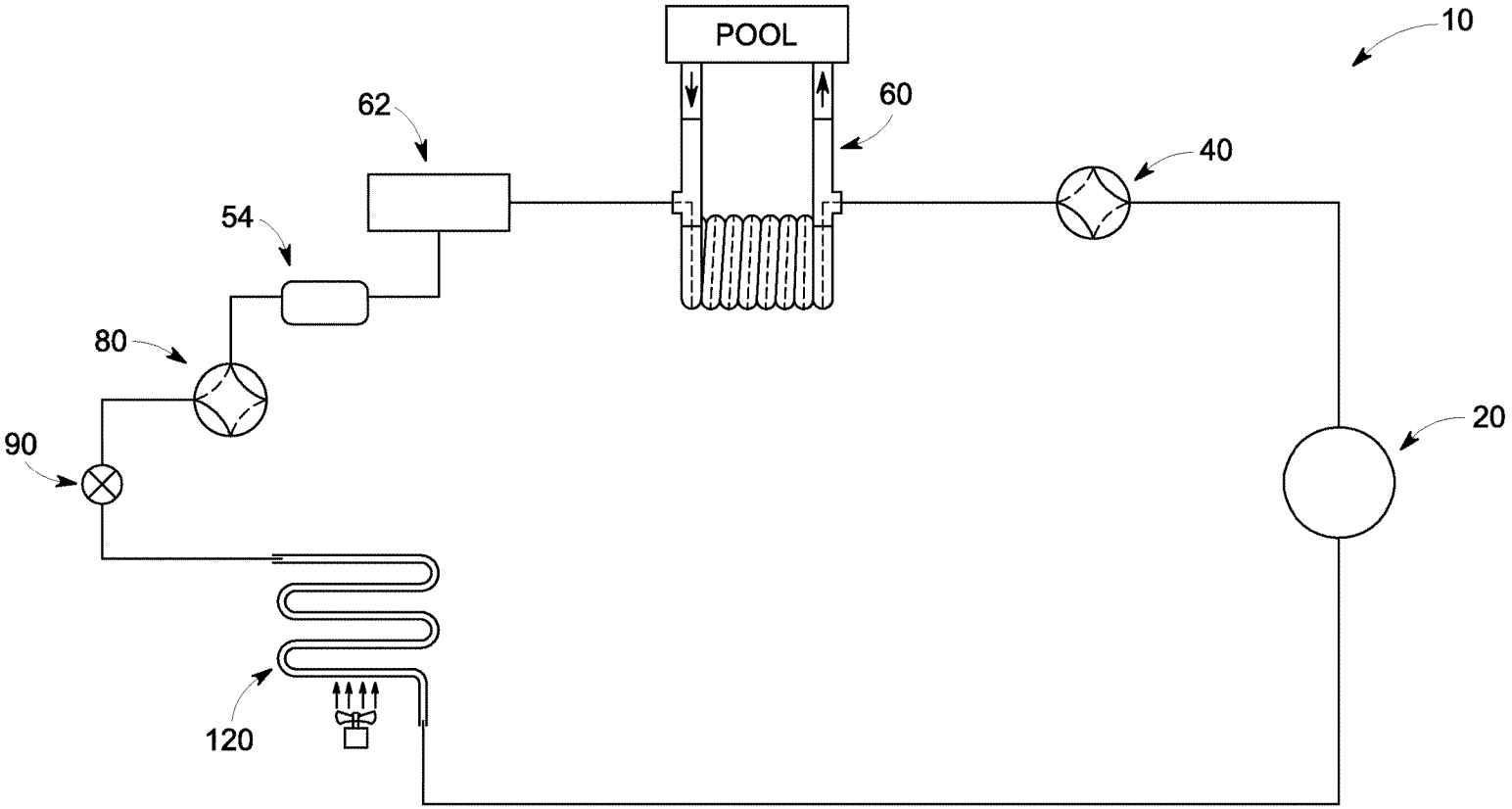
FIG. 3 shows a schematic of the present invention showing only the components used when the house needs to be cooled and the pool needs to be heated. All of the components, with the exception of home evaporator expansion valve 90 and home evaporator 120 are included within the same hybrid unit 300 seen in FIG. 1. They are separated in this view for the purposes of explaining how the system operates.

Now that the pool has been heated, if the home needs to be cooled, home thermostat 202 would have sent a signal indicating such to second valve coils 214 are actuated instructing second 4-way valve 80 to allow liquid created by water condenser 60 to pass to home expansion valve 90 and then to home evaporator 120 to cool the house. This embodiment showing the pool having been heated and the house cooled is shown in FIG. 3.

Upon cooling the house, home evaporator 120 converts the liquid into a vapor that is suctioned back by compressor 20. As shown in FIG. 6, the electrical components of the present invention further include fan motor relay 216 that activates fan 102. Fan motor relay 216 is not activated when both the pool needs to be heated and house needs to be cooled. Fan motor relay 216 is only activated when the house does not need to be cooled since hybrid unit 300 will have to act as the evaporator in the system.

Figure 5:
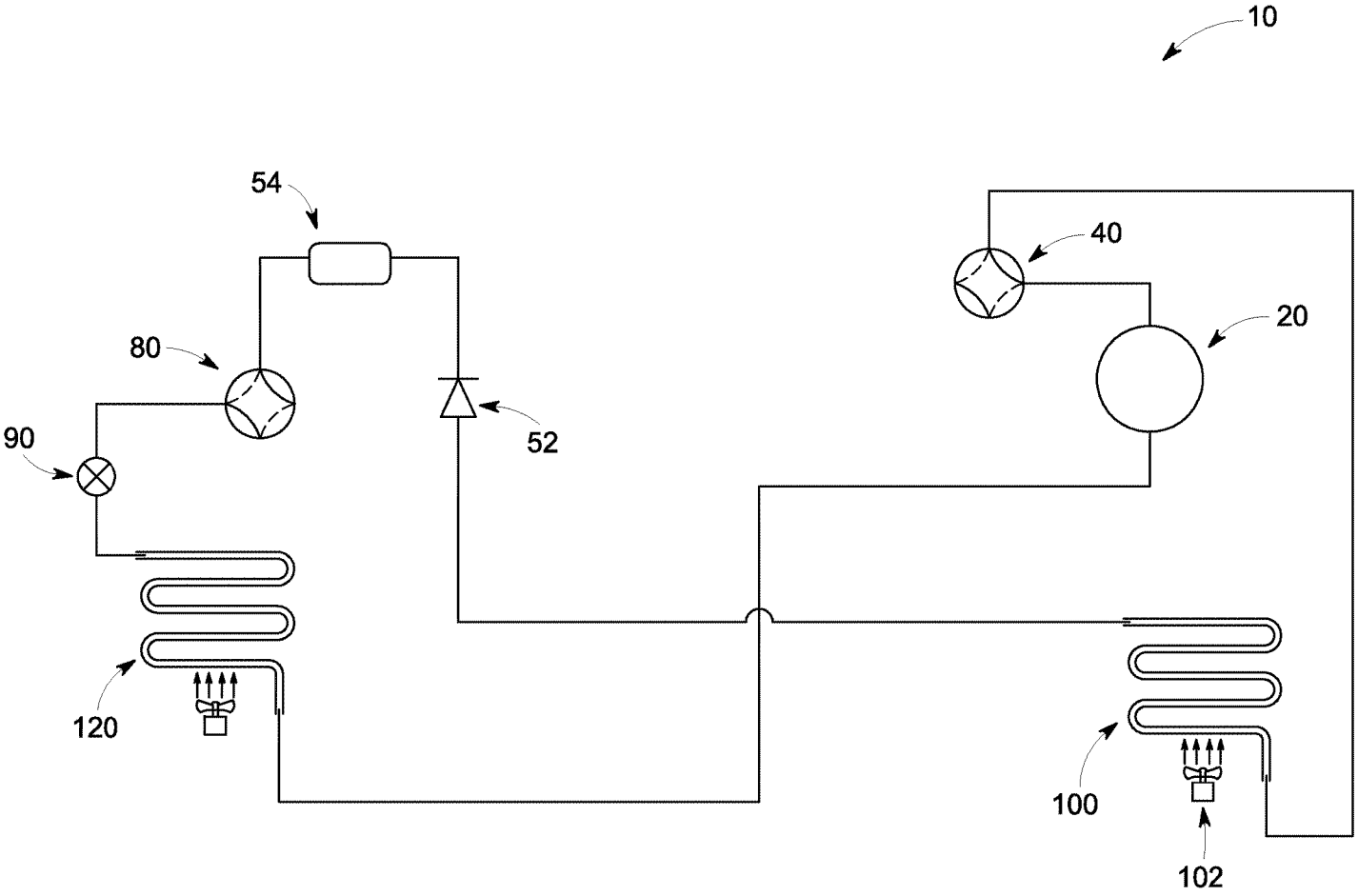
FIG. 5 is a schematic of the present invention showing only the components used when the pool does not need to be heated and the house needs to be cooled. All of the components, with the exception of home evaporator expansion valve 90 and home evaporator 120 are included within the same hybrid unit 300 seen in FIG. 1. They are separated in this view for the purposes of explaining how the system operates.

In the event that the pool does not need to be heated but the house needs to be cooled as shown in FIG. 5, pool thermostat 200 will not allow current to pass to pool relay 206, thereby not activating first 4-way valve 40. When first 4-way valve 40 is not activated and home thermostat 202 activates compressor contact 204, compressor 20 still distributes hot gas. However, since first 4-way valve 40 is not activated, the hot gas will be directed using tube 23 to evaporator 100 of hybrid condenser/evaporator unit 300, which will operate as a condenser in this example. Hybrid condenser/evaporator unit 300 converts the hot gas into a liquid that passes through second check valve 52 using tube 46, then through filter dryer 54 using tubes 46*a* and 26*b* that filters debris while absorbing humidity, and then the liquid is received by second 4-way valve 80 using tube 27. Home thermostat 202 when triggered, sends current to the coil of home relay 212 which passes current to the coil of the compressor's contact. When second valve coil 214 and second four-way valve 80 are actuated, the liquid is passed to home expansion valve 90 using tube 32 and then to home evaporator 120 using tube 34. The liquid is then converted into vapor by home evaporator 120 and suctioned by compressor 20 using return tubes 35, 36, and 29 and 48 to suction through first four-way valve 40 and then using tube 21 to suction back into compressor 20, as shown in FIG. 2.

Figure 4:
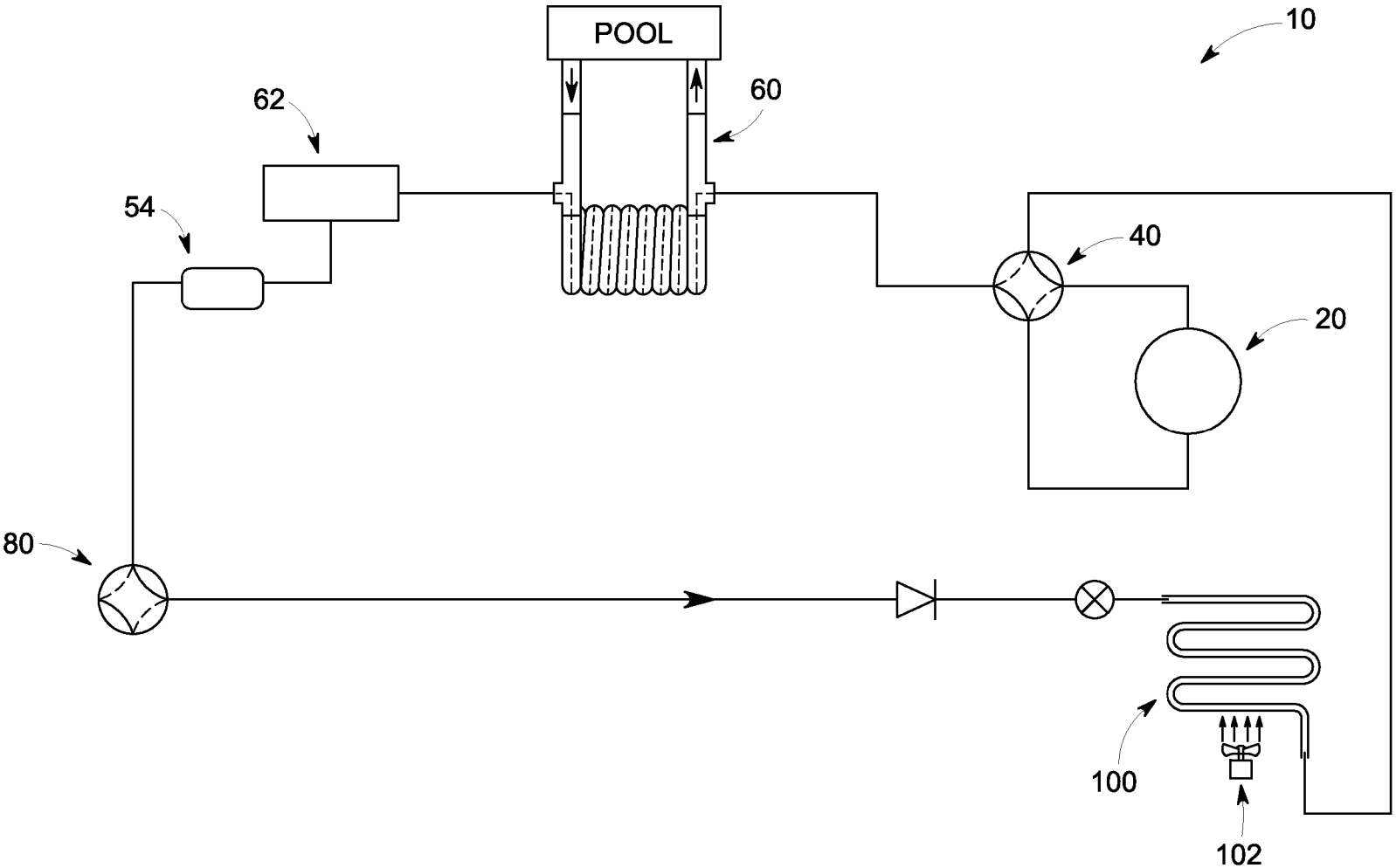
FIG. 4 illustrates a schematic of the present invention showing only the components used when the pool needs to be heated and the home does not need to be cooled. All of the components, with the exception of home evaporator expansion valve 90 and home evaporator 120 are included within the same hybrid unit 300 seen in FIG. 1. They are separated in this view for the purposes of explaining how the system operates.

If the pool needs to be heated and the house does not need to be cooled, as shown in FIG. 4, then pool thermostat 200 provides current to pool relay 206 that activates first valve coil 208. This action activates compressor 20 to distribute gas to water condenser 60 to heat the pool. Since home thermostat 202 was not activated, second valve coil 214 was not activated and, thus, the liquid leaving water condenser 60 is passed to hybrid expansion valve 110 using tubes 28 and 44 and then to evaporator 100 of hybrid condenser/evaporator unit 300 using tube 42. Evaporator 100 of hybrid condenser/evaporator 300 converts the liquid into vapor using fan 102. Here, hybrid condenser/evaporator 300 is now acting as an evaporator. The vapor is then passed to first 4-way valve 40 using tube 23 then suctioned back to compressor 20 using tube 21.

As shown in FIG. 1, home evaporator 120 is connected to control unit 400 that includes the home thermostat 202 and home transformer 203. Hybrid condenser/evaporator 300 has hybrid control unit 500 connected thereto that communicates with control unit 400.

The system further includes energy saving switch 225 that a user can activate so that the system uses water condenser 60 in combination with home evaporator 120 to cool the house when pool thermostat 200 is off because using water condenser 60 instead of hybrid evaporator/condenser 100 is more efficient.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system comprising:

a hybrid condenser/evaporator unit including a compressor, a pool condenser, a hybrid unit evaporator/condenser including a fan, a home thermostat, a pool thermostat, a first and second four-way valve that decide the order in which the previously mentioned components are used in the system in addition to suctioning vapor throughout the system back to said compressor, a home control unit, and an hybrid unit electrical control unit, said home evaporator unit connected to a home evaporator unit expansion valve, and a plurality of tubing to pass hot gas between said compressor and said pool condenser or said hybrid evaporator/condenser, said plurality of tubing also used to pass condensed liquid from said pool condenser or hybrid evaporator/condenser to said hybrid evaporator/condenser or said home expansion valve, said plurality of tubing is also used to pass evaporated liquid back to said compressor, a flow switch connected to said pool condenser, a first check valve that prevents gas or liquids from entering said pool condenser, a fan motor relay that activates said fan when a house does not need to be cooled, an energy saving switch that orchestrates when pool condenser is used of when hybrid evaporator/condenser is used as the system's condenser.

2. The system set forth in claim 1 further including a flow switch that actuates said first four-way valve to send hot gas to said hybrid evaporator/condenser that acts as a condenser in combination with said home evaporator that acts as evaporator.

3. The system set forth in claim 1 further including a liquid receiver connected to said condenser.

4. The system set forth in claim 1 including a filter dryer.

5. The hybrid evaporator/condenser unit set forth in claim 1 wherein hot gas is distributed from said compressor to said first four-way valve and then to said pool condenser when said pool thermostat indicates the pool needs to be heated, said condenser converts said hot gas to a liquid that passes to said second four-way valve, said second four-way valve sends said liquid to said home evaporator unit expansion valve if said home thermostat indicates that the home needs to be cooled, the home evaporator unit then cools the house and returns the resulting vapor to said compressor.

6. The hybrid evaporator/condenser unit set forth in claim 1 wherein hot gas is distributed from said compressor to said first four-way valve and then to said hybrid unit evaporator that functions as a water condenser when the pool does not need to be heated, said hybrid unit evaporator converts the hot gas to said liquid and passed it to said second four-way valve, when said home thermostat indicates the home needs to be cooled, said liquid is passed to said home evaporator unit expansion valve if said home thermostat indicates that the home needs to be cooled, the home evaporator unit then cools the house and returns the resulting vapor to said compressor.

7. The hybrid evaporator/condenser unit set forth in claim 1 wherein hot gas is distributed from said compressor to said first four-way valve and then to said pool condenser when said pool thermostat indicates the pool needs to be heated, said condenser converts said hot gas to a liquid that passes to said second four-way valve, said second four-way valve sends said liquid to said hybrid unit evaporator if said home thermostat indicates that the home does not need to be cooled, the hybrid unit evaporator then converts said liquid to said vapor and returns the resulting vapor to said compressor to being the cycle again.

* * * * *